US006964308B1

(12) United States Patent
Zupanick

(10) Patent No.: US 6,964,308 B1
(45) Date of Patent: Nov. 15, 2005

(54) METHOD OF DRILLING LATERAL WELLBORES FROM A SLANT WELL WITHOUT UTILIZING A WHIPSTOCK

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 188 days.

(21) Appl. No.: 10/267,426

(22) Filed: Oct. 8, 2002

(51) Int. Cl.[7] ..... E21B 7/06
(52) U.S. Cl. ..... 175/61; 175/62
(58) Field of Search ..... 175/61, 62, 74, 175/75; 166/117.5

(56) References Cited

U.S. PATENT DOCUMENTS

| | | | | |
|---|---|---|---|---|
| 54,144 | A | 4/1866 | Hamar | |
| 274,740 | A | 3/1883 | Douglass | |
| 526,708 | A | 10/1894 | Horton | |
| 639,036 | A | 12/1899 | Heald | |
| 1,189,560 | A | 7/1916 | Gondos | |
| 1,285,347 | A | 11/1918 | Otto | |
| 1,467,480 | A | 9/1923 | Hogue | |
| 1,485,615 | A | 3/1924 | Jones | |
| 1,488,106 | A | 3/1924 | Fitzpatrick | |
| 1,520,737 | A | 12/1924 | Wright | |
| 1,674,392 | A | 6/1928 | Flansburg | |
| 1,777,961 | A | 10/1930 | Capeliuschnicoff | |
| 2,018,285 | A | 10/1935 | Schweitzer et al. | 166/21 |
| 2,069,482 | A | 2/1937 | Seay | 255/76 |
| 2,150,228 | A | 3/1939 | Lamb | 166/10 |
| 2,169,718 | A | 8/1939 | Boll et al. | 255/24 |
| 2,335,085 | A | 11/1943 | Roberts | 251/197 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,726,063 | A | 12/1955 | Ragland et al. | 255/1.8 |
| 2,726,847 | A | 12/1955 | McCune et al. | 255/1.6 |
| 2,783,018 | A | 2/1957 | Lytle | 251/25 |
| 2,797,893 | A | 7/1957 | McCune et al. | |

(Continued)

FOREIGN PATENT DOCUMENTS

| | | | |
|---|---|---|---|
| AU | 85/49964 A | 11/1986 | |
| CA | 2210866 | 1/1998 | |
| CA | 2 278 735 | 1/1998 | E21C/21/24 |

(Continued)

OTHER PUBLICATIONS

Notification of Transmittal of the International Search Report or the Declaration (PCT Rule 44.1) mailed Nov. 6, 2003 (8 pages) re International Application No. PCT/US 03/21626, Filed Jul. 11, 2003.

(Continued)

*Primary Examiner*—David Bagnell
*Assistant Examiner*—Matthew J. Smith
(74) *Attorney, Agent, or Firm*—Fish & Richardson P.C.

(57) ABSTRACT

In accordance with one embodiment of the present invention, a method for drilling a lateral wellbore from a slant well includes drilling the slant well below the surface of the earth such that the slant well is angled toward a first horizontal direction that coincides with a desired drilling direction for the lateral wellbore. The slant well has a borehole wall that includes a high side portion closest to the surface, a low side portion farthest from the surface, and two side portions between the high side portion and the low side portion. The method further includes disposing a casing string in the slant well, disposing a drill string having a bent sub, a mud motor, and a drill bit coupled at a lower end thereof in the casing string, and positioning the drill bit adjacent either one of the side portions or the low side portion. The method further includes drilling, from either the side portion or the low side portion, an intermediate wellbore with the drill bit, and drilling, from the intermediate wellbore, the lateral wellbore in the desired drilling direction.

19 Claims, 4 Drawing Sheets

U.S. PATENT DOCUMENTS

| | | | | |
|---|---|---|---|---|
| 2,847,189 | A | 8/1958 | Shook | 255/76 |
| 2,911,008 | A | 11/1959 | Du Bois | 137/625.31 |
| 2,980,142 | A | 4/1961 | Turak | 137/637.3 |
| 3,163,211 | A | 12/1964 | Henley | |
| 3,208,537 | A | 9/1965 | Scarborough | 175/53 |
| 3,347,595 | A | 10/1967 | Dahms et al. | 299/4 |
| 3,385,382 | A | 5/1968 | Canalizo et al. | |
| 3,443,648 | A | 5/1969 | Howard | 175/103 |
| 3,473,571 | A | 10/1969 | Dugay | 137/625.4 |
| 3,503,377 | A | 3/1970 | Beatenbough et al. | 123/117 |
| 3,528,516 | A | 9/1970 | Brown | 175/267 |
| 3,530,675 | A | 9/1970 | Turzillo | 61/35 |
| 3,578,077 | A | 5/1971 | Glenn et al. | |
| 3,582,138 | A | 6/1971 | Loofbourow et al. | |
| 3,587,743 | A | 6/1971 | Howard | |
| 3,684,041 | A | 8/1972 | Kammerer, Jr. et al. | 175/267 |
| 3,692,041 | A | 9/1972 | Bondi | 137/238 |
| 3,744,565 | A | 7/1973 | Brown | |
| 3,757,876 | A | 9/1973 | Pereau | 175/267 |
| 3,757,877 | A | 9/1973 | Leathers | 175/269 |
| 3,800,830 | A | 4/1974 | Etter | 137/625.41 |
| 3,809,519 | A | 5/1974 | Garner | 425/245 |
| 3,825,081 | A | 7/1974 | McMahon | 175/73 |
| 3,828,867 | A | 8/1974 | Elwood | 175/45 |
| 3,874,413 | A | 4/1975 | Valdez | 137/625.47 |
| 3,887,008 | A | 6/1975 | Canfield | 166/267 |
| 3,902,322 | A | 9/1975 | Watanabe | 61/35 |
| 3,907,045 | A | 9/1975 | Dahl et al. | 175/45 |
| 3,934,649 | A | 1/1976 | Pasini, III et al. | 166/254 |
| 3,957,082 | A | 5/1976 | Fuson et al. | 137/625.41 |
| 3,961,824 | A | 6/1976 | Van Eek et al. | 299/17 |
| 4,011,890 | A | 3/1977 | Andersson | 137/625.4 |
| 4,020,901 | A | 5/1977 | Pisio et al. | |
| 4,022,279 | A | 5/1977 | Driver | 166/271 |
| 4,030,310 | A | 6/1977 | Schirtzinger | |
| 4,037,658 | A | 7/1977 | Anderson | 166/272 |
| 4,060,130 | A | 11/1977 | Hart | |
| 4,073,351 | A | 2/1978 | Baum | 175/14 |
| 4,089,374 | A | 5/1978 | Terry | 166/259 |
| 4,116,012 | A | 9/1978 | Abe et al. | 405/238 |
| 4,134,463 | A | 1/1979 | Allen | 175/53 |
| 4,136,996 | A | 1/1979 | Burns | |
| 4,151,880 | A | 5/1979 | Vann | |
| 4,156,437 | A | 5/1979 | Chivens et al. | 137/554 |
| 4,169,510 | A | 10/1979 | Meigs | 175/65 |
| 4,182,423 | A | 1/1980 | Ziebarth et al. | |
| 4,189,184 | A | 2/1980 | Green | 299/8 |
| 4,220,203 | A | 9/1980 | Steeman | 166/271 |
| 4,221,433 | A | 9/1980 | Jacoby | 299/4 |
| 4,222,611 | A | 9/1980 | Larson et al. | |
| 4,224,989 | A | 9/1980 | Blount | 166/250 |
| 4,226,475 | A | 10/1980 | Frosch et al. | |
| 4,257,650 | A | 3/1981 | Allen | 299/2 |
| 4,278,137 | A | 7/1981 | Van Eek | 175/267 |
| 4,283,088 | A | 8/1981 | Tabakov et al. | 299/2 |
| 4,296,785 | A | 10/1981 | Vitello et al. | 141/105 |
| 4,299,295 | A | 11/1981 | Gossard | 175/45 |
| 4,303,127 | A | 12/1981 | Freel et al. | 166/266 |
| 4,305,464 | A | 12/1981 | Masszi | 166/370 |
| 4,312,377 | A | 1/1982 | Knecht | 137/625.19 |
| 4,317,492 | A | 3/1982 | Summers et al. | 175/79 |
| 4,328,577 | A | 5/1982 | Abbott et al. | 370/84 |
| 4,333,539 | A * | 6/1982 | Lyons et al. | 175/61 |
| 4,366,988 | A | 1/1983 | Bodine | 299/14 |
| 4,372,398 | A | 2/1983 | Kuckes | 175/45 |
| 4,386,665 | A | 6/1983 | Dellinger | 175/61 |
| 4,390,067 | A | 6/1983 | Willman | 166/245 |
| 4,396,076 | A | 8/1983 | Inoue | 175/265 |
| 4,397,360 | A | 8/1983 | Schmidt | 175/61 |
| 4,401,171 | A | 8/1983 | Fuchs | 175/267 |
| 4,407,376 | A | 10/1983 | Inoue | 175/267 |
| 4,415,205 | A | 11/1983 | Rehm et al. | |
| 4,417,829 | A | 11/1983 | Berezoutzky | |
| 4,422,505 | A | 12/1983 | Collins | |
| 4,437,706 | A | 3/1984 | Johnson | 299/7 |
| 4,442,896 | A | 4/1984 | Reale et al. | 166/278 |
| 4,463,988 | A | 8/1984 | Bouck et al. | |
| 4,494,616 | A | 1/1985 | McKee | 175/67 |
| 4,502,733 | A | 3/1985 | Grubb | |
| 4,512,422 | A | 4/1985 | Knisley | 175/99 |
| 4,519,463 | A | 5/1985 | Schuh | 175/61 |
| 4,527,639 | A | 7/1985 | Dickinson, III et al. | 175/61 |
| 4,532,986 | A | 8/1985 | Mims et al. | 166/50 |
| 4,533,182 | A | 8/1985 | Richards | |
| 4,536,035 | A | 8/1985 | Huffman et al. | |
| 4,544,037 | A | 10/1985 | Terry | 166/369 |
| 4,558,744 | A | 12/1985 | Gibb | 166/335 |
| 4,565,252 | A | 1/1986 | Campbell et al. | 175/269 |
| 4,573,541 | A | 3/1986 | Josse et al. | 175/78 |
| 4,599,172 | A | 7/1986 | Gardes | 210/314 |
| 4,600,061 | A | 7/1986 | Richards | 175/62 |
| 4,603,592 | A | 8/1986 | Siebold et al. | |
| 4,605,076 | A | 8/1986 | Goodhart | 175/61 |
| 4,611,855 | A | 9/1986 | Richards | 299/2 |
| 4,618,009 | A | 10/1986 | Carter et al. | 175/267 |
| 4,638,949 | A | 1/1987 | Mancel | 239/307 |
| 4,646,836 | A | 3/1987 | Goodhart | 166/303 |
| 4,651,836 | A | 3/1987 | Richards | |
| 4,674,579 | A | 6/1987 | Geller et al. | 175/45 |
| 4,676,313 | A | 6/1987 | Rinaldi | |
| 4,702,314 | A | 10/1987 | Huang et al. | 166/245 |
| 4,705,109 | A | 11/1987 | Ledent et al. | |
| 4,705,431 | A | 11/1987 | Gadelle et al. | 405/267 |
| 4,715,440 | A | 12/1987 | Boxell et al. | 166/100 |
| 4,718,485 | A | 1/1988 | Brown et al. | |
| 4,727,937 | A | 3/1988 | Shum et al. | |
| 4,753,485 | A | 6/1988 | Goodhart | |
| 4,754,819 | A | 7/1988 | Dellinger | 175/61 |
| 4,756,367 | A | 7/1988 | Puri et al. | 166/263 |
| 4,763,734 | A | 8/1988 | Dickinson et al. | 175/61 |
| 4,773,488 | A | 9/1988 | Bell et al. | 175/61 |
| 4,776,638 | A | 10/1988 | Hahn | |
| 4,830,105 | A | 5/1989 | Petermann | 166/241 |
| 4,832,122 | A | 5/1989 | Corey et al. | |
| 4,836,611 | A | 6/1989 | El-Saie | 299/7 |
| 4,842,081 | A | 6/1989 | Parant | 175/23 |
| 4,844,182 | A | 7/1989 | Tolle | 175/215 |
| 4,852,666 | A | 8/1989 | Brunet et al. | 175/61 |
| 4,883,122 | A | 11/1989 | Puri et al. | 166/248 |
| 4,889,186 | A | 12/1989 | Hanson et al. | |
| 4,978,172 | A | 12/1990 | Schwoebel et al. | 299/12 |
| 5,016,709 | A | 5/1991 | Combe et al. | |
| 5,016,710 | A | 5/1991 | Renard et al. | 166/245 |
| 5,033,550 | A | 7/1991 | Johnson et al. | |
| 5,035,605 | A | 7/1991 | Dinerman et al. | 481/18 |
| 5,036,921 | A | 8/1991 | Pittard et al. | 166/298 |
| 5,074,360 | A | 12/1991 | Guinn | 166/281 |
| 5,074,365 | A | 12/1991 | Kuckes | 175/40 |
| 5,074,366 | A | 12/1991 | Karlsson et al. | 175/76 |
| 5,082,054 | A | 1/1992 | Kiamanesh | 166/248 |
| 5,111,893 | A | 5/1992 | Kvello-Aune | 175/258 |
| 5,115,872 | A | 5/1992 | Brunet et al. | |
| 5,127,457 | A | 7/1992 | Stewart et al. | |
| 5,135,058 | A | 8/1992 | Millgard et al. | 175/71 |
| 5,148,875 | A | 9/1992 | Karlsson et al. | 175/62 |
| 5,148,877 | A | 9/1992 | MacGregor | |
| 5,165,491 | A | 11/1992 | Wilson | 175/62 |
| 5,168,942 | A | 12/1992 | Wydrinski | 175/50 |
| 5,174,374 | A | 12/1992 | Hailey | 166/55.8 |
| 5,193,620 | A | 3/1993 | Braddick | 166/382 |
| 5,194,859 | A | 3/1993 | Warren | 340/853.4 |

5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,226,495 A 7/1993 Jennings, Jr. ..... 166/278
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,289,888 A 3/1994 Talley
5,301,760 A 4/1994 Graham ..... 175/61
5,343,965 A 9/1994 Talley et al.
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al. ..... 166/265
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,584,605 A 12/1996 Beard et al. ..... 405/128
5,613,242 A 3/1997 Oddo ..... 588/17
5,615,739 A 4/1997 Dallas ..... 166/306
5,653,286 A 8/1997 McCoy et al. ..... 166/105.5
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4
5,697,445 A 12/1997 Graham
5,706,871 A 1/1998 Andersson et al. ..... 141/59
5,720,356 A 2/1998 Gardes ..... 175/62
5,727,629 A 3/1998 Blizzard, Jr. et al. ..... 166/298
5,735,350 A 4/1998 Longbottom et al. ..... 166/313
5,771,976 A 6/1998 Talley ..... 166/370
5,775,433 A 7/1998 Hammett et al. ..... 166/98
5,775,443 A 7/1998 Lott
5,785,133 A 7/1998 Murray et al. ..... 175/61
5,832,958 A 11/1998 Cheng ..... 137/625.41
5,853,054 A 12/1998 McGarian et al. ..... 175/267
5,853,056 A 12/1998 Landers ..... 175/424
5,853,224 A 12/1998 Riese
5,863,283 A 1/1999 Gardes ..... 588/250
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,917,325 A 6/1999 Smith ..... 324/326
5,934,390 A 8/1999 Uthe ..... 175/67
5,938,004 A 8/1999 Roberts et al. ..... 198/812
5,941,307 A 8/1999 Tubel
5,941,308 A 8/1999 Malone et al.
5,944,107 A 8/1999 Ohmer
5,957,539 A 9/1999 Durup et al. ..... 299/4
5,971,074 A 10/1999 Longbottom et al. ..... 166/313
5,988,278 A 11/1999 Johnson
6,012,520 A 1/2000 Yu et al. ..... 166/245
6,015,012 A 1/2000 Reddick ..... 166/313
6,019,173 A 2/2000 Saurer et al.
6,024,171 A 2/2000 Montgomery et al. ..... 166/308
6,030,048 A 2/2000 Hsu
6,050,335 A 4/2000 Parsons ..... 166/272.3
6,056,059 A 5/2000 Ohmer ..... 166/313
6,062,306 A 5/2000 Gano et al.
6,065,550 A 5/2000 Gardes ..... 175/62
6,065,551 A 5/2000 Gourley et al.
6,079,495 A 6/2000 Ohmer
6,089,322 A 7/2000 Kelley et al.
6,119,771 A 9/2000 Gano et al. ..... 166/50
6,119,776 A 9/2000 Graham et al.
6,135,208 A 10/2000 Gano et al. ..... 166/313
6,170,571 B1 1/2001 Ohmer
6,179,054 B1 1/2001 Stewart ..... 166/105.5
6,189,616 B1 2/2001 Gano et al.
6,192,988 B1 2/2001 Tubel
6,199,633 B1 3/2001 Longbottom
6,209,636 B1 4/2001 Roberts et al. ..... 166/117.6
6,237,284 B1 5/2001 Erickson
6,244,340 B1 6/2001 McGlothen et al.
6,247,532 B1 6/2001 Ohmer
6,263,965 B1 7/2001 Schmidt et al.
6,279,658 B1 8/2001 Donovan et al.
6,280,000 B1 8/2001 Zupanick ..... 299/12
6,283,216 B1 9/2001 Ohmer
6,318,457 B1 11/2001 Den Boer et al.
6,349,769 B1 2/2002 Ohmer ..... 166/313
6,357,523 B1 3/2002 Zupanick ..... 166/52
6,357,530 B1 3/2002 Kennedy et al. ..... 166/369
6,425,448 B1 7/2002 Zupanick et al. ..... 175/61
6,439,320 B2 8/2002 Zupanick ..... 175/161
6,450,256 B2 9/2002 Mones ..... 166/250.01
6,454,000 B1 9/2002 Zupanick
6,457,540 B2 10/2002 Gardes
6,491,101 B2 12/2002 Ohmer
6,497,556 B2 12/2002 Zupanick et al.
6,554,063 B2 4/2003 Ohmer
6,557,628 B2 5/2003 Ohmer
6,564,867 B2 5/2003 Ohmer
6,566,649 B1 5/2003 Mickael ..... 250/269.3
6,571,888 B2 6/2003 Comeau et al. ..... 175/61
6,575,255 B1 6/2003 Rial et al.
6,577,129 B1 6/2003 Thompson et al. ..... 324/338
6,585,061 B2 7/2003 Radzinski et al. ..... 175/45
6,590,202 B2 7/2003 Mickael ..... 250/269.2
6,591,903 B2 * 7/2003 Ingle et al. ..... 175/61
6,591,922 B1 7/2003 Rial et al.
6,595,301 B1 7/2003 Diamond et al.
6,595,302 B1 7/2003 Diamond et al.
6,604,910 B1 8/2003 Zupanick
6,607,042 B2 8/2003 Hoyer et al. ..... 175/38
6,636,159 B1 10/2003 Winnacker ..... 340/854.3
6,639,210 B2 10/2003 Odom et al. ..... 250/269.6
6,644,422 B1 11/2003 Rial et al.
6,646,441 B2 11/2003 Thompson et al. ..... 324/338
6,653,839 B2 11/2003 Yuratich et al. ..... 324/355
6,679,322 B1 1/2004 Zupanick
6,722,452 B1 4/2004 Rial et al.
6,758,279 B2 7/2004 Moore et al.
2001/0010432 A1 8/2001 Zupanick
2001/0015574 A1 8/2001 Zupanick et al.
2002/0043404 A1 4/2002 Trueman et al.

| | | | | |
|---|---|---|---|---|
| 2002/0050358 | A1 | 5/2002 | Algeroy et al. | 166/313 |
| 2002/0074120 | A1 | 6/2002 | Scott | 166/313 |
| 2002/0074122 | A1 | 6/2002 | Kelley et al. | |
| 2002/0096336 | A1 | 7/2002 | Zupanick et al. | |
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0164253 | A1 | 9/2003 | Trueman et al. | |
| 2003/0217842 | A1 | 11/2003 | Zupanick et al. | |
| 2003/0221836 | A1 | 12/2003 | Gardes | |
| 2004/0011560 | A1 | 1/2004 | Rial et al. | |
| 2004/0020655 | A1 | 2/2004 | Rusby et al. | |
| 2004/0031609 | A1 | 2/2004 | Zupanick | |
| 2004/0033557 | A1 | 2/2004 | Scott et al. | |
| 2004/0055787 | A1 | 3/2004 | Zupanick | |
| 2004/0060351 | A1 | 4/2004 | Gunter et al. | |
| 2004/0108110 | A1 | 6/2004 | Zupanick | |
| 2004/0118558 | A1 | 6/2004 | Rial et al. | |
| 2004/0140129 | A1 | 7/2004 | Gardes | |
| 2004/0149432 | A1 | 8/2004 | Zupanick | |
| 2004/0154802 | A1 | 8/2004 | Zupanick | |
| 2004/0159436 | A1 | 8/2004 | Zupanick | |
| 2004/0206493 | A1 | 10/2004 | Zupanick et al. | |
| 2004/0226719 | A1 | 11/2004 | Morgan et al. | |

FOREIGN PATENT DOCUMENTS

| | | | | |
|---|---|---|---|---|
| DE | 653 741 | | 1/1986 | E21B/43/24 |
| DE | 197 25 996 | A1 | 1/1998 | |
| EP | 0 819 834 | A1 | 1/1998 | |
| EP | 0 875 661 | A1 | 11/1998 | E21B/43/30 |
| EP | 0 952 300 | A1 | 10/1999 | E21B/7/12 |
| EP | 1 316 673 | A2 | 6/2003 | |
| FR | 964503 | | 4/1944 | 8/1 |
| GB | 442008 | | 1/1936 | |
| GB | 444484 | | 3/1936 | |
| GB | 651468 | | 4/1951 | |
| GB | 893869 | | 4/1962 | |
| GB | 2 255 033 | A | 10/1992 | |
| GB | 2 255 033 | | 10/1992 | B04B/11/02 |
| GB | 2 297 988 | | 8/1996 | E21B/7/08 |
| GB | 2 347 157 | A | 8/2000 | E21B/43/00 |
| RU | SU-876968 | | 10/1981 | |
| SU | 750108 | | 6/1975 | E21C/45/00 |
| SU | 1448078 | A1 | 3/1987 | E21F/5/00 |
| SU | 1770570 | A1 | 3/1990 | E21F/7/00 |
| WO | 94/21889 | | 9/1994 | E21B/43/24 |
| WO | WO 94/28280 | | 12/1994 | |
| WO | WO 97/21900 | | 6/1997 | |
| WO | WO 98/25005 | | 6/1998 | |
| WO | WO 98/35133 | | 8/1998 | E21C/27/24 |
| WO | WO 99/60248 | | 11/1999 | E21B/43/30 |
| WO | 00/31376 | | 6/2000 | E21C/41/00 |
| WO | WO 00/79099 | | 12/2000 | E21B/43/25 |
| WO | WO 01/44620 | | 6/2001 | E21B/43/38 |
| WO | WO 02/18738 | | 3/2002 | E21B/7/04 |
| WO | WO 02/061238 | | 8/2002 | E21B/43/00 |
| WO | WO 03/102348 | | 12/2003 | |
| WO | WO 2004/035984 | A1 | 4/2004 | |
| WO | WO 2005/003509 | A1 | 1/2005 | |

OTHER PUBLICATIONS

Notification of Transmittal of the International Search Report or the Declaration (PCT Rule 44.1) mailed Nov. 5, 2003 (8 pages) re International Application No. PCT/US 03/21627, Filed Jul. 11, 2003.

Notification of Transmittal of the International Search Report or the Declaration (PCT Rule 44.1) mailed Nov. 4, 2003 (7 pages) re International Application No. PCT/US 03/21628, Filed Jul. 11, 2003.

Notification of Transmittal of the International Search Report or the Declaration (PCT Rule 44.1) mailed Dec. 5, 2003 (8 pages) re International Application No. PCT/US 03/21750, Filed Jul. 11, 2003.

Examiner of Record, Office Action Response regarding the Interpretation of the three Russian Patent Applications listed above under Foreign Patent Documents (9 pages), Date Unknown.

B. Gotas et al., "*Performance of Openhole Completed and Cased Horizontal/Undulating Wells in Thin–Bedded, Tight Sand Gas Reservoirs*," Society of Petroleum Engineers, Inc., Oct. 17 through Oct. 19, 2000, pp. 1–7.

R. Sharma, et al., "*Modelling of Undulating Wellbore Trajectories, The Journal of Canadian Petroleum Technology*", XP–002261908, Oct. 18–20, 1993, pp 16–24.

E. F. Balbinski et al., "*Prediction of Offshore Viscous Oil Field Performance*," European Symposium on Improved Oil Recovery, Aug. 18, 1999–Aug. 20, 2000, pp. 1–10.

Chi, Weiguo, "*A Feasible Discussion on Exploitation Coalbed Methane through Horizontal Network Drilling in China*", SPE 64709, Society of Petroleum Engineers (SPE International), 4 pages, Nov. 7, 2000.

Chi, Weiguo, "*Feasibility of Coalbed Methane Exploitation in China*", synopsis of paper SPE 64709, 1 page, Nov. 7, 2000.

Ian D. Palmer et al., "*Coalbed Methane Well Completions and Stimulations*", Chapter 14, pp. 303–339, Hydrocarbons from Coal, Published by the American Association of Petroleum Geologists, 1993.

Notification of Transmittal of the International Search Report or the Declaration (PCT Rule 44.1) mailed Dec. 19, 2003 (6 pages) re International Application No. PCT/US 03/28137, Dec. 19, 2003.

Notification of Transmittal of the International Search Report or the Declaration (PCT Rule 44.1) mailed Feb. 4, 2004 (8 pages) re International Application No. PCT/US 03/26124, Feb. 04, 2004.

Smith, Maurice, "*Chasing Unconventional Gas Unconventionally*," CBM Gas Technology, New Technology Magazine, Oct./Nov. 2003, pp. 1–4.

Gardes, Robert "*A New Direction in Coalbed Methane and Shale Gas Recovery*," (to the best of Applicants' recollection, first received at The Canadian Institute Coalbed Methane Symposium conference on Jun. 16 and Jun. 17, 2002), 1 page of conference flyer, 6 pages of document.

Gardes, Robert, "*Under–Balance Multi–Lateral Drilling for Unconventional Gas Recovery*," (to the best of Applicants' recollection, first received at The Unconventional Gas Revolution conference on Dec. 9, 2003), 4 pages of conference flyer, 33 pages of document.

Boyce, Richard "*High Resolution Selsmic Imaging Programs for Coalbed Methane Development*," (to the best of Applicants' recollection, first received at The Unconventional Gas Revolution conference on Dec. 10, 2003), 4 pages of conference flyer, 24 pages of document.

Mark Mazzella and David Strickland, "*Well Control Operations on a Multiwell Plaform Blowout*," WorldOil.com—Online Magazine Article, vol. 22, Part I—pp. 1–7, and Part II—pp. 1–13, Jan. 2002.

Vector Magnetics LLC, Case History, California, May 1999, "*Successful Kill of a Surface Blowout*," pp. 1–12.

Cudd Pressure Control, Inc, "*Successful Well Control Operations—A Case Study: Surface and Subsurface Well Intervention on a Multi–Well Offshore Platform Blowout and Fire*," pp. 1–17, http://www.cuddwellcontrol.com/literature/successful/successful_well.htm, 2000.

R. Purl, et al., "*Damage to Coal Permeability During Hydraulic Fracturing*," pp. 109–115 (SPE 21813), 1991.

U.S. Dept. of Energy—Office of Fossil Energy, "*Multi–Seam Well Completion Technology: Implications for Powder River Basin Coalbed Methane Production*," pp. 1–100, A–1 through A10, Sep. 2003.

U.S. Dept. of Energy—Office of Fossil Energy, "*Powder River Basin Coalbed Methane Development and Produced Water Management Study*," pp. 1–111, A–1 through A14, Sep. 2003.

Robert W. Taylor and Richard Russell, Multilateral Technologies Increase Operational Efficiencies in Middle East, Oil & Gas Journal, pp. 76–80, Mar. 16, 1998.

Adam Pasiczynk, "Evolution Simplifies Multilateral Wells", Directional Drilling, pp. 53–55, Jun. 2000.

Steven S. Bell, "Multilateral System with Full Re–Entry Access Installed", World Oil, p. 29, Jun. 1996.

P. Jackson and S. Kershaw, Reducing Long Term Methane Emissions Resulting from Coal Mining, Energy Convers. Mgmt, vol. 37, Nos. 6–8, pp. 801–806, 1996.

Pascal Breant, "Des Puits Branches, Chez Total : les puits multi drains", Total Exploration Production, pp. 1–5, Jan. 1999.

McCray and Cole, "Oil Well Drilling and Technology," *University of Oklahoma Press*, pp 315–319, 1959.

Berger and Anderson, "Modern Petroleum;" *PennWell Books*, pp 106–108, 1978.

Howard L. Hartman, et al.; "SME Mining Engineering Handbook;" *Society for Mining, Metallurgy, and Exploration, Inc.*; pp 1946–1950, 2nd Edition, vol. 2, 1992.

Dave Hassan, Mike Chernichen, Earl Jensen, and Morley Frank; "Multi–lateral technique lowers drilling costs, provides environmental benefits", *Drilling Technology*, pp. 41–47, Oct. 1999.

Gopal Ramaswamy, "Production History Provides CBM Insights," *Oil & Gas Journal*, pp. 49, 50 and 52, Apr. 02, 2001.

Arfon H. Jones et al., A Review of the Physical and Mechanical Properties of Coal with Implications for Coal–Bed Methane Well Completion and Production, *Rocky Mountain Association of Geologists*, pp. 169–181, 1988.

Joseph C. Stevens, Horizontal Applications For Coal Bed Methane Recovery, *Strategic Research Institute*, pp. 1–10 (slides), Mar. 25, 2002.

Weiguo Chi and Luwu Yang, "Feasibility of Coalbed Methane Exploitation in China," *Horizontal Well Technology*, p. 74, Sep. 2001.

Nackerud Product Description, *Harvest Tool Company,LLC*, 1 page, Received Sep. 27, 2001.

Gopal Ramaswamy, "Advances Key For Coalbed Methane," *The American Oil & Gas Reporter*, pp. 71 & 73, Oct. 2001.

R.J. "Bob" Stayton, "Horizontal Wells Boost CBM Recovery", Special Report: Horizontal & Directional Drilling, *The American Oil & Gas Reporter*, pp. 71–75, Aug. 2002.

U.S. Appl. No. 09/769,098, entitled "Method and System for Enhanced Access to a Subterranean Zone," filed Jan. 24, 2001, 65 pages.

U.S. Appl. No. 09/774,996, entitled "Method and System for Accessing a Subterranean Zone From a Limited Surface Area," filed Jan. 30, 2001, 67 pages.

U.S. Appl. No. 09/788,897, entitled "Method and System for Accessing Subterranean Deposits From The Surface," filed Feb. 20, 2001, 54 pages.

U.S. Appl. No. 10/142,817, entitled "Method and System for Underground Treatment of Materials," filed May 8, 2002, 54 pgs.

U.S. Appl. No. 09/885,219, entitled "Method and System for Accessing Subterranean Deposits From The Surface," filed Jun. 20, 2001, 52 pages.

U.S. Appl. No. 10/046,001, entitled "Method and System for Management of By–Products From Subterranean Zones," filed Oct. 19, 2001. 42 pages.

U.S. Appl. No. 10/004,316, entitled "Slant Entry Well System and Method," filed Oct. 30, 2001, 35 pages.

U.S. Appl. No. 10/123,561, entitled "Method and System for Accessing Subterranean Zones From a Limited Surface," filed Apr. 5, 2002, 49 pages.

U.S. Appl. No. 10/123,556, entitled "Method and System for Accessing Subterranean Zones From a Limited Surface," filed Apr. 5, 2002, 49 pages.

U.S. Appl. No. 10/165,627, entitled "Method and System for Accessing Subterranean Deposits from the Surface," filed Jun. 7, 2002, 26 pages.

U.S. Appl. No. 10/165,625, entitled "Method and System for Accessing Subterranean Deposits from the Surface," filed Jun. 7, 2002, 26 pages.

Pend U.S. Appl. No., Joseph A. Zupanick, "Method and System for Accessing a Subterranean Zone From a Limited Surface," SN 10/188,141, Jul. 01, 2002.

Pend U.S. Appl. No., Joseph A. Zupanick, "Undulating Well Bore," SN 10/194,366, Jul. 12, 2002.

Pend U.S. Appl. No., Joseph A. Zupanick, "RampingWell Bores," SN 10/194,367, Jul. 12, 2002.

Pend U.S. Appl. No., Joseph A. Zupanick, "Wellbore Sealing System and Method," SN 10/194,.368, Jul. 12, 2002.

Pend U.S. Appl. No., Joseph A. Zupanick, "Wellbore Plug System and Method," SN 10/194,422, Jul. 12, 2002.

Pend U.S. Appl. No., Joseph a. Zupanick, "System and Method for Subterranean Access" SN 10/227,057, Aug. 22, 2002.

Pend U.S. Appl. No., Joseph A. Zupanick et al., Method and System for Controlling Pressure in a Dual Well System, Sep. 12, 2002.

Pend U.S. Appl. No., Joseph A. Zupanick, "Three–Dimensional Well System for Accessing Subterranean Zones", SN 10/244,083, Sep. 12, 2002.

Pend U.S. Appl. No., Joseph A. Zupanick, "Accelerated Production of Gas From a Subterranean Zone", SN 10/246, 052, Sep. 17, 2002.

Pend U.S. Appl. No., Joseph A. Zupanick, "Method and System for Removing Fluid From a Subterranean Zone Using an Enlarged Cavity", SN 10/264,535, Oct. 03, 2002.

Susan Eaton, "Reversal of Fortune", New Technology Magazine, pp 30–31, Sep. 2002.

James Mahony, "A Shadow of Things to Come", New Technology Magazine, pp. 28–29, Sep. 2002.

Documents Received from Third Party, Great Lakes Directional Drilling, Inc., (12 pages), Received Sep. 12, 2002.

Notification of Transmittal of the International Search Report or the Declaration (PCT Rule 44.1) mailed Feb. 27, 2004 (9 pages) re International Application No. PCT/US 03/30126, Sep. 23, 2003.
Fletcher, "Anadarko Cuts Gas Route Under Canadian River Gorge," Oil and Gas Journal, pp. 28–30, Jan. 25, 2004.
Kalinin, et al., "Drilling Inclined and Horizontal Well Bores," Nedra Publishers, Moscow, 1997, 15 pages.
Arens, V.Zh., "Well–Drilling Recovery of Minerals," Geotechnology, Nedra Publishers, Moscow, 7 pages, 1986.
Notification of Transmittal of the International Search Report or the Declaration (PCT Rule 44.1) mailed Feb. 9, 2004 (6 pages) re International Application No. PCT/US 03/28138, Sep. 09, 2003.
Translation of selected pages of Kalinin, et al., "Drilling Inclined and Horizontal Well Bores," Nedra Publishers, Moscow, 1997, 15 pages.
Translation of selected pages of Arens, V.Zh., "Well–Drilling Recovery of Minerals," Geotechnology, Nedra Publishers, Moscow, 7 pages, 1986.
Notification of Transmittal of the International Search Report or the Declaration (PCT Rule 44.1) (3 pages) and International Search Report (7 pages) re International Application No. PCT/US 03/04771 mailed Jul. 4, 2003.
Notification of Transmittal of the International Search Report or the Declaration (PCT Rule 44.1) (3 pages) and International Search Report (5 pages) re International Application No. PCT/US 03/21891 mailed Nov. 13, 2003.
Notification of Transmittal of the International Search Report or the Declaration (PCT Rule 44.1) (3 pages) and International Search Report (4 pages) re International Application No. PCT/US 03/38383 mailed Jun. 2, 2004.
Kalinin, et al., Translation of Selected Pages from Ch. 4, Sections 4.2 (p. 135), 10.1 (p. 402), 10.4 (pp. 418–419), "*Drilling Inclined and Horizontal Well Bores*", Moscow, Nedra Publishers, 1997, 4 pages.
Jet Lavanway Exploration, "*Well Survey*," Key Energy Surveys, Nov. 2, 1997, 3 pages.
Precision Drilling, "*We Have Roots in Coal Bed Methane Drilling*, " Technology Services Group, Published on or before Aug. 5, 2002, 1 page.
U.S. Dept. of Energy, "*New Breed of CBM/CMM Recovery Technology*, " Jul. 2003, 1 page.
Ghiselin, Dick, "*Unconventional Vision Frees Gas Reserves*," Natural Gas Quarterly, Sep. 2003, 2 pages.
CBM Review, World Coal, "*US Drilling into Asia*, " Jun. 2003, 4 pages.
Skrebowski, Chris, "*US Interest in North Korean Reserves*," Petroleum, Energy Institute, Jul. 2003, 4 pages.
Zupanick, et al., U.S. Patent Application entitled "Method and System for Recirculating Fluid in a Well System," U.S. Appl. No. 10/457,103, Jun. 5, 2003 (41 pages).
Pauley, Steven, U.S. Patent Application entitled "Multi–Purpose Well Bores and Method for Accessing a Subterranean Zone From the Surface," U.S. Appl. No. 10/715,300, Nov. 17, 2003 (34 pages).
Seams, Douglas, U.S. Patent Application entitled "Method and System for Extraction of Resources from a Subterranean Well Bore," U.S. Appl. No. 10/723,322, Nov. 26, 2003 (40 pages).
Zupanick, U.S. Patent Application entitled "Method and System for Testing A Partially Formed Hydrocarbon Well for Evaluation and Well Planning Refinements," U.S. Appl. No. 10/769,221, Jan. 30, 2004 (34 pages).
Platt, "Method and System for Lining Multilateral Wells," U.S. Appl. No. 10/772,841, Feb. 5, 2004 (30 pages).
Zupanick, "System And Method For Directional Drilling Utilizing Clutch Assembly," U.S. Appl. No. 10/811,118, Mar. 25, 2004 (35 pages).
Zupanick, "System and Method for Multiple Wells from a Common Surface Location," U.S. Appl. No. 10/788,694, Feb. 27, 2004 (26 pages).
Field, T.W., "*Surface to In–seam Drilling—The Australian Experience*, " Undated, 10 pages.
Drawings included in CBM well permit issued to CNX stamped Apr. 15, 2004 by the West Virginia Department of Environmental Protection (5 pages).
Website of Mitchell Drilling Contractors, "*Services: Dymaxion—Surface to In–seam*," http://www.mitchell drilling.com/dymaxion.htm, printed as of Jun. 17, 2004, 4 pages.
Website of CH4, "About Natural Gas—Technology," http://www.ch4.com.au/ng_technology.html, copyright 2003, printed as of Jun. 17, 2004, 4 pages.
Thomson, et al., "*The Application of Medium Radius Directional Drilling for Coal Bed Methane Extraction*," Lucas Technical Paper, copyrighted 2003, 11 pages.
U.S. Department of Energy, DE–FC26–01NT41148, "*Enhanced Coal Bed Methane Production and Sequestration of CO2 in Unmineable Coal Seams*" for Consol, Inc., accepted Oct. 1, 2001, 48 pages.
U.S. Department of Energy, "*Slant Hole Drilling*," Mar. 1999, 1 page.
Desai, Praful, et al., "*Innovative Design Allows Construction of Level 3 or Level 4 Junction Using the Same Platform*," SPE/Petroleum Society of CIM/CHOA 78965, Canadian Heavy Oil Association, 2002, pp. 1–11.
Bybee, Karen, "*Advanced Openhole Multilaterals*," Horizontal Wells, Nov. 2002, pp. 41–42.
Emerson. A.B., et al., "*Moving Toward Simple, Highly Functional Multilateral Completions*," Technical Note, Journal of Canadian Petroleum Technology, May 2002, vol. 41, No. 5, pp. 9–12.
Moritis, Guntis, "*Complex Well Geometries Boost Orinoco Heavy Oil Producing Rates*," XP–000969491, Oil & Gas Journal, Feb. 28, 2000, pp. 42–46.
Themig, Dan, "*Multilateral Thinking*," New Technology Magazine, Dec. 1999, pp. 24–25.
Smith, R.C., et al., "*The Lateral Tie–Back System: The Ability to Drill and Case Multiple Laterals*," IADC/SPE 27436, Society of Petroleum Engineers, 1994, pp. 55–64, plus Multilateral Services Profile (1 page) and Multilateral Services Specifications (1 page).
Notification of Transmittal of the International Search Report or the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane*," Hydrocarbons From Coal, Chapter 12, Copyright 1993, Title Page, Copyright Page, pp. 269–285.
Hanes, John, "*Outbursts in Leichhardt Colliery: Lessons Learned*," International Symposium–Cum–Workshop on Management and Control High Gas Emissions and Outbursts in Underground Coal Mines, Wollongong, NSW, Australia, Mar. 20–24, 1995, Title page, pp. 445–449.
Williams, Ray, et al., "*Gas Reservoir Properties for Mine Gas Emission Assesment*," Bowen Basin Symposium 2000, pp. 325–333.

Brown, K., et al., "*New South Wales Coal Seam Methane Potential*," Petroleum Bulletin 2, Department of Mineral Resources, Discovery 2000, Mar. 1996, pp. i–viii, 1–96.

Fipke, S., et al., "*Economical Multilateral Well Technology for Canadian Heavy Oil*," Petroleum Society, Canadian Institute of Mining, Metallurgy & Petroleum, Paper 2002–100, to be presented in Calgary Alberta, Jun. 11–13, 2002, pp. 1–11.

PowerPoint Presentation entitled, "Horizontal Coalbed Methane Wells," by Bob Stayton, Computalog Drilling Services, date is believed to have been in 2002 (39 pages).

Denney, Dennis, "*Drilling Maximum–Reservoir–Contact Wells in the Shaybah Field*," SPE 85307, pp. 60, 62–63, Oct. 20, 2003.

Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.

Brunner, D.J. and Schwoebel, J.J., "Directional Drilling for Methane Drainage and Exploration in Advance of Mining," REI Drilling Directional Underground, World Coal, 1999, 10 pages.

Thakur, P.C., "A History of Coalbed Methane Drainage From United States Coal Mines," 2003 SME Annual Meeting, Feb. 24–26, Cincinnati, Ohio, 4 pages.

U.S. Climate Change Technology Program, "Technology Options for the Near and Long Term," 4.1.5 Advances in Coal Mine Methane Recovery Systems, pp. 162–164.

Notification of Transmittal of the International Search Report and the Written Opinion of the International Searching Authority, or the Declaration (3 pages), International Search Report (3 pages) and Written Opinion of the International Searching Authority (7 pages) re International Application PCT/US2004/017048 mailed Oct. 21, 2004.

Gardes, Robert, "Multi–Seam Completion Technology," Natural Gas Quarterly, E&P, Jun. 2004, pp. 78–81.

Baiton, Nicholas, "Maximize Oil Production and Recovery," Vertizontal Brochure, received Oct. 2, 2002, 4 pages.

Dreilling, Tim, McClelland, M.L. and Bilyeu, Brad, "Horizontal & High Angle Air Drilling in the San Juan Basin, New Mexico," Dated on or about Mar. 6, 2003, pp. 1–11.

Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94–09, paper to be presented Mar. 20–23, 1994, Calgary, Canada, 10 pages.

Fischer, Perry A., "What's Happening in Production," World Oil, Jun. 2001, p. 27.

Website of PTTC Network News Vol. 7, 1st Quarter 2001, Table of Contents, http://www.pttc.org/../news/v7nlnn4.htm printed Apr. 25, 2003, 3 pages.

Cox, Richard J.W., "Testing Horizontal Wells While Drilling Underbalanced," Delft University of Technology, Aug. 1998, 68 pages.

McLennan, John, et al., "Underbalanced Drilling Manual," Gas Research Institute, Chicago, Illinois, GRI Reference No. GRI–97/0236, copyright 1997, 502 pages.

"The Need for a Viable Multi–Seam Completion Technology for the Powder River Basin," Current Practice and Limitations, Gardes Energy Services, Inc., Believed to be 2003 (8 pages).

Langley, Diane, "Potential Impact of Microholes Is Far From Diminutive," JPT Online, http://www.spe.org/spe/jpt/jps, Nov. 2004 (5 pages).

Consol Energy Slides, "Generating Solutions, Fueling Change," Presented at Appalachian E&P Forum, Harris, Nesbitt Corp., Boston, Oct. 14, 2004 (29 pages).

Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Oct. 10, 2004.

Schenk, Christopher J., "Geologic Definition and Resource Assesment of Continuous (Unconventional) Gas Accumulations—the U.S. Experience," Website, http://aapg.confex.com/...//, printed Nov. 16, 2004 (1 page).

U.S. Department of Interior, U.S. Geological Survey, "Characteristics of Discrete and Basin–Centered Parts of the Lower Silurian Regional Oil and Gas Accumulation, Applachian Basin: Preliminary Results From a Data Set of 25 oil and Gas Fields," U.S. Geological Survey Open–File Report 98–216, Website, http://pubs.usgs.gov/of/1998/of98–216/introl.htm, printed Nov. 16, 2004 (2 pages).

Listing of 14 References received from Third Party on Feb. 16, 2005 (9 pages).

Gardes Directional Drilling, "Multiple Directional Wells From Single Borehole Developed," Reprinted from Jul. 1989 edition of Offshore, Copyright 1989 by PennWell Publishing Company (4 pages).

"Economic Justification and Modeling of Multilateral Wells," Economic Analysis, Hart's Petroleum Engineer International, 1997 (4 pages).

Mike Chambers, "Multi–Lateral Completions at Mobil Past, Present, and Future," presented at the 1998 Summit on E&P Drilling Technologies, Strategic Research Institute, Aug. 18–19, 1998 in San Antonio, Texas (26 pages).

David C. Oyler adn William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Institute, Aug. 18–19, 1998 in San Antonio, Texas (56 pages).

P. Corlay, D. Bossie–Codreanu, J.C. Sabathier and E.R. Delamaide, "Improving Reservoir Management With Complex Well Architectures," Field Production & Reservoir Management, World Oil, Jan. 1997 (5 pages).

Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).

Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).

Gamal Ismail, H. El–Khatib—ZADCO, Abu Dhabi, UAE, "Multi–Lateral Horizontal Drilling Problems & Solutions Experienced Offshore Abu Dhabi," SPE 36252, Society of Petroleum Engineers, Oct. 1996 (12 pages).

C.M. Matthews and L.J. Dunn, "Drilling and Production Practices to Mitigate Sucker Rod/Tubing Wear–Related Failures in Directional Wells," SPE 22852, Society of Petroleum Engineers, Oct. 1991 (12 pages).

H.H. Fields, Stephen Krickovic, Albert Sainato, and M.G. Zabetakis, "Degasification of Virgin Pittsburgh Coalbed Through a Large Borehole," RI–7800, Bureau of Mines Report of Investigations/1973, United States Department of the Interior, 1973 (31 pages).

William P. Diamond, "Methane Control for Underground Coal Mines," IC–9395, Bureau of Mines Information Circular, United States Department of the Interior, 1994 (51 pages).

Dreiling, Tim, McClelland, M.L. and Bilyeu, Brad, "Horizontal & High Angle Air Drilling in the San Juan Basin, New Mexico," Believed to be dated Apr. 1996, pp. 1–11.

Technology Scene Drilling & Intervention Services, "Weatherford Moves Into Advanced Multilateral Well Completion Technology," and "Productivity Gains and Safety Record Speed Acceptance of UBS," *Reservoir Mechanics*, Weatherford International, Inc., 2000 Annual Report (2 pages).

"A Different Direction for CBM Wells," *W Magazine*, 2004 Third Quarter (5 pages).

Snyder, Robert E., "What's New in Production," *WorldOil Magazine*, Feb. 2005, [printed from the internet on Mar. 7, 2005], http://www.worldoil.com/magazine/MAGAZINE_DETAIL.asp?ART_ID=2507@MONTH_YEAR (3 pages).

Nazzal, Greg, "Moving Multilateral Systems to the Next Level, Strategic Acquisition Expands Weatherford's Capabilities,"2000 (2 pages).

Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).

Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.

King, Robert F., "Drilling Sideways—A Review of Horizontal Well Technology and Its Domestic Application," DOE/EIA–TR–0565, U.S. Department of Energy, Apr. 1993, 30 pages.

Santos, Helio, SPE, Impact Engineering Solutions and Jesus Olaya, Ecopetrol/ICP, "*No–Damage Drilling: How to Achieve this Challenging Goal?*," SPE 77189, Copyright 2002, presented at the IADC/SPE Asia Pacific Drilling Technology, Jakarta, Indonesia, Sep. 9–11, 2002, 10 pages.

Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20–23, 2002, 7 pages.

Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC 85304, Society of Petroleum Engineers, Copyright 2003, presented at the SPE/IADC Middle East Drilling Technology Conference & Exhibition in Abu Chabi,UAE, Oct. 20–22, 2003, 8 pages.

P. Reid, SPE, and H. Santos, SPE, Impact Solutions Group, "*Novel Drilling, Completion adn Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20–22, 2003, 9 pages.

Craig C. White and Adrian P. Chesters, NAM; Catalina D. Ivan, Sven Maikranz and Rob Nouris, M–I L.L.C., "*Aphron–based drilling fluid: Novel technology for drilling depleted formations*," WORLD OIL, Drilling Report Special Focus, Oct. 2003, 6 pages.

U.S. Enviromental Protection Agency, "Directional Drilling Technology," prepared for the EPA by Advanced Resources International under Contract 68–W–00–094, Coalbed Methane Outreach Program (CMOP), Website: http://search.epa.gov/s97is.vts, printed Mar. 17, 2005, 13 pages.

Robert E. Snyder, "Drilling Advances," WORLD OIL, Oct. 2003, 1 page.

"Meridian Tests New Technology," Western Oil World, Jun. 1990, Cover, Table of Contents and p. 13.

Clint Leazer and Michael R. Marquez, "Short–Radius Drilling Expands Horizontal Well Applications," Petroleum Engineer International, Apr. 1995, 6 pages.

Terry R. Logan, "Horizontal Drainhole Drilling Techniques Used in Rocky Mountains Coal Seams," Geology and Coal–Bed Methane Resources of the Northern San Juan Basin, Colorado and New Mexico, Rocky Mountain Association of Geologists, Goal–Bed Methane, San Juan Basin, 1988, pp. cover, 13–142.

Daniel J. Brunner, Jeffrey J. Schwoebel, and Scott Thomson, "Directional Drilling for Methane Drainage & Exploration in Advance of Mining," Website: http://www.advminigtech.com.au/Paper4.htm, printed Apr. 6, 2005, Copyright 1999, Last modified Aug. 7, 2002 (8 pages).

Karen Bybee, highlights of paper SPE 84424, "Coalbed–Methane Reservoir Simulation: An Evolving Science," by T.L. Hower, JPT Online, Apr. 2004, Website: http://www.spe.org/spe/jpt/jsppapersynopsis/0.2439.1104_11038_2354949_2395832.00.html, printed Apr. 14, 2005, 4 pages.

Kevin Meaney and Lincoln Paterson, "Relative Permeability in Coal," SPE 36986, Society of Petroleum Engineers, Copyright 1996, pp. 231–236.

Calendar of Events—Conference Agenda, Fifth Annual Unconventional Gas and Coalbed Methane Conference, Oct. 22–24, 2003, in Calgary Alberta, Website: http://www.csug.ca/cal/calc0301a.html, printed Mar. 17, 2005, 5 pages.

Tom Engler and Kent Perry, "Creating a Roadmap for Unconventional Gas R&D," Gas TIPS, Fall 2002, pp. 16–20.

CSIRO Petroleum—SIMEDWin, "Summary of SIMEDWin Capabilities," Copyright 1997–2005, Website: http://www.dpr.csiro.au/ourcapabilities/petroleumgeoengineering/reservoirengineering/projects/simedwin/assets/simed/index.html, printed Mar. 17, 2005, 10 pages.

Solutions From the Field, "Coalbed Methane Resources in the Southeast," Copyright 2004, Website: http://www.pttc.org/solutions/sol_2004/537.html, printed Mar. 17, 2005, 7 pages.

Jeffrey R. Levine, Ph.D., "Matrix Shrinkage Coefficient," Undated, 3 pages.

G. Twombly, S.H. Stepanek, T.A. Moore, Coalbed Methane Potential in the Waikato Coalfield of New Zealand: A Comparison With Developed Basins in the United States, 2004 New Zealand Petroleum Conference Proceedings, Mar. 7–10, 2004, pp. 1–6.

R. W. Cade, "Horizontal Wells: Development and Applications," Presented at the Fifth International Symposium on Geophysics for Mineral, Geotechnical and Enviromental Applications, Oct. 24–28, 1993 in Tulsa, Oklahoma, Website://www.mgls.org/97Sym/Cade/cade.html, printed Mar. 17, 2005, 6 pages.

Solutions From the Field, "Horizontal Drilling, A Technology Update for the Appalachian Basin," Copyright 2004, Website: http://www.pttc.org/solutions/sol_2004/535.htm, printed Mar. 17, 2005, 6 pages.

R. Purl, J.C. Evanoff and M.L. Brugler, "Measurement of Coal Cleat Porosity and Relative Permeability Characteristics," SPEA 21491, Society fo Petroleum Engineers, Copyright 1991, pp. 93–104.

Peter Jackson, "Drilling Technologies for Underground Coal Gasification," IMC Geophysics Ltd., International UCG Workshop—Oct. 2003 (20 pages).

Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.

Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.

Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2004/036616 mailed Feb. 24, 2005.

Zupanick, J., "Coalbed Methane Extraction," 28$^{th}$ Mineral Law Conference, Lexington, Kentucky, Oct. 16–17, 2003 (48 pages).

Zupanick, J., "CDX Gas—Pinnacle Project," Presentation at the 2002 Fall Meeting of North American Coal Bed Methane Forum, Morgantown, West Virginia, Oct. 30, 2002 (23 pages).

Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22–23, 2004 (51 pages).

Field, Tony, Mitchell Drilling, "Let's Get Technical—Drilling Breakthroughs in Surface to In–Seam in Australia," Presentation at Coal Seam Gas & Mine Methane Conference in Brisbane, Nov. 22–23, 2004 (20 pages).

Zupanick, Joseph A, "Coal Mine Methane Drainage Utilizing Multilateral Horizontal Wells," 2005 SME Annual Meeting & Exhibit, Feb. 28—Mar. 2, 2005, Salt Lake City, Utah (6 pages).

The Official Newletter of the Cooperative Research Centre for Mining Technology and Equipment, CMTE News 7, "Tight–Radius Drilling Clinches Award," Jun. 2001, 1 page.

* cited by examiner

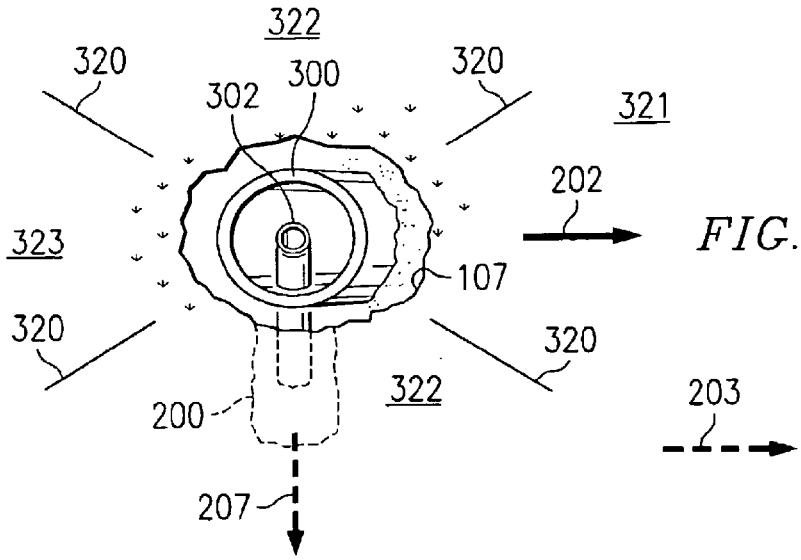
FIG. 3B
FIG. 4
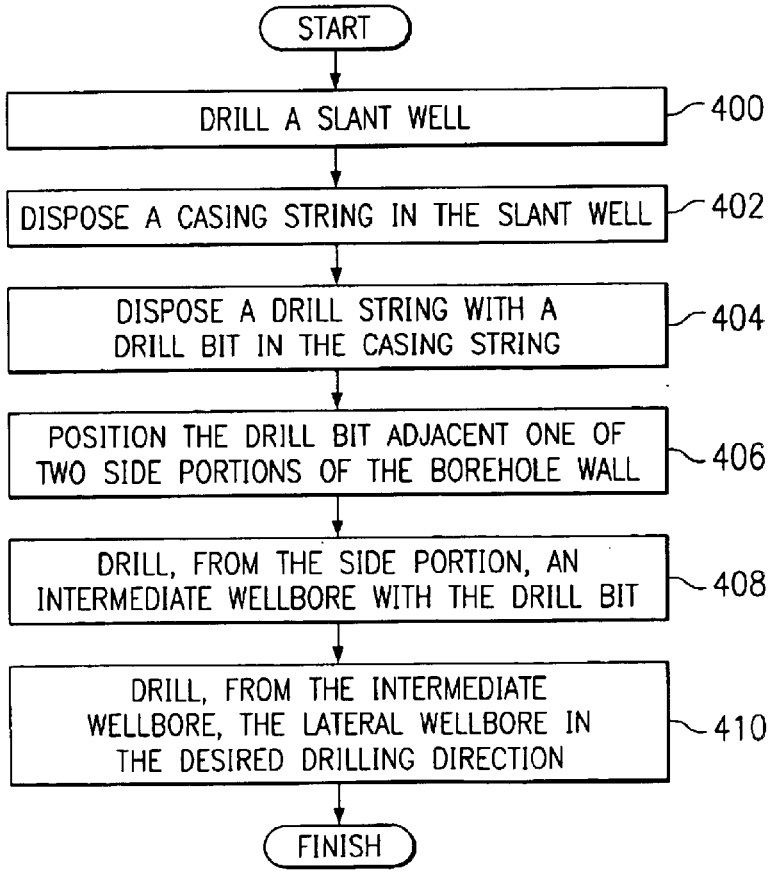

METHOD OF DRILLING LATERAL WELLBORES FROM A SLANT WELL WITHOUT UTILIZING A WHIPSTOCK

TECHNICAL FIELD OF THE INVENTION

The present invention relates generally to systems and methods for the recovery of subterranean resources and, more particularly, to a method of drilling lateral wellbores from a slant well without utilizing a whipstock.

BACKGROUND OF THE INVENTION

Subterranean deposits of coal (typically referred to as "coal seams") often contain substantial quantities of entrained methane gas. Limited production and use of methane gas from coal seams has occurred for many years because substantial obstacles have frustrated extensive development and use of methane gas deposits in coal seams.

One system of obtaining methane gas from coal seams is to drill lateral wellbores into the coal seams. This is typically accomplished by a drill bit at the end of a drill string that is disposed within a casing string having a deflecting member at the lower end thereof. The deflecting member, sometimes referred to as a "whipstock," directs the drill bit such that a lateral wellbore may be drilled in the coal seam.

SUMMARY OF THE INVENTION

The present invention provides a wellbore sealing system and method that substantially eliminates or reduces the disadvantages and problems associated with previous systems and methods.

In accordance with one embodiment of the present invention, a method for drilling a lateral wellbore from a slant well includes drilling the slant well below the surface of the earth such that the slant well is angled toward a first horizontal direction that coincides with a desired drilling direction for the lateral wellbore. The slant well has a borehole wall that includes a high side portion closest to the surface, a low side portion farthest from the surface, and two side portions between the high side portion and the low side portion. The method further includes disposing a casing string in the slant well, disposing a drill string having a bent sub, a mud motor, and a drill bit coupled at a lower end thereof in the casing string, and positioning the drill bit adjacent either one of the side portions or the low side portion. The method further includes drilling, from either the side portion or the low side portion, an intermediate wellbore with the drill bit, and drilling, from the intermediate wellbore, the lateral wellbore in the desired drilling direction.

Some embodiments of the present invention may provide one or more technical advantages. These technical advantages may include more efficient drilling and production of methane gas and greater reduction in costs and problems associated with other drilling systems and methods. For example, a whipstock does not have to be used to direct a drill bit to drill a lateral wellbore. Another technical advantage is that underbalanced drilling may be performed along with the teachings of one embodiment of the present invention.

Other technical advantages of the present invention are readily apparent to one skilled in the art from the figures, descriptions, and claims included herein.

BRIEF DESCRIPTION OF THE DRAWINGS

For a more complete understanding of the present invention and its advantages, reference is now made to the following description taken in conjunction with the accompanying drawings, wherein like numerals represent like parts, in which:

FIGS. 3A and 3B are different cross-sectional views of the perspective view of FIG. 2; and FIG. 4 is a flowchart demonstrating an example method for drilling lateral wellbores from a slant well according to one embodiment of the present invention.

DETAILED DESCRIPTION OF THE INVENTION

Embodiments of the present invention and their advantages are best understood by referring now to FIGS. 1 through 4 of the drawings, in which like numerals refer to like parts.

Figure 1:
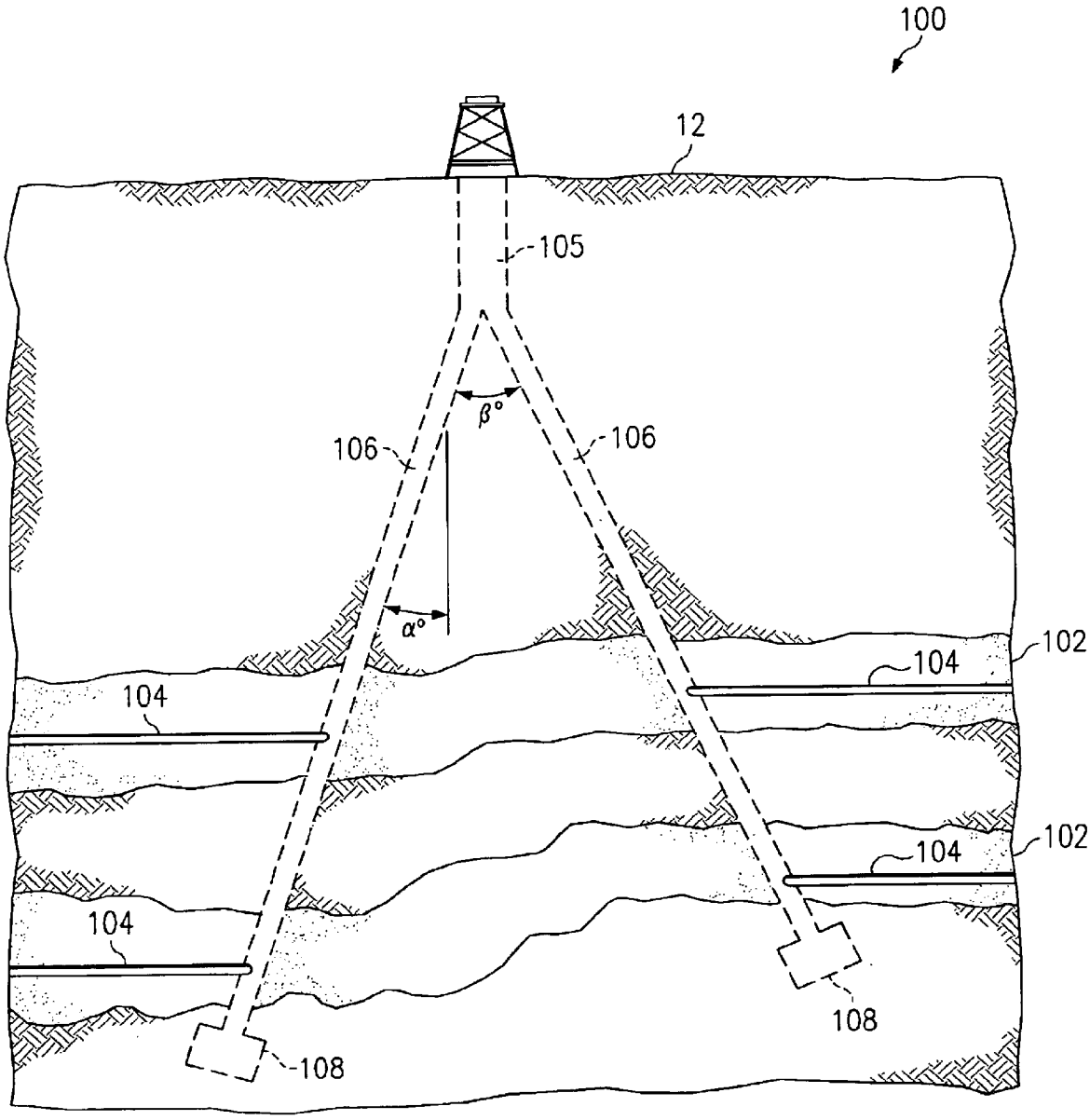
FIG. 1 is a cross-sectional view of the earth illustrating an example slant well system for production of resources from one or more subterranean zones via one or more lateral wellbores.

FIG. 1 is a cross-sectional view of the earth illustrating an example well system 100 for production of resources from one or more subterranean zones 102 via one or more lateral wellbores 104. In various embodiments described herein, subterranean zones 102 are coal seams; however, other subterranean formations may be similarly accessed using well system 100 of the present invention to remove and/or produce water, gas, or other fluids. System 100 may also be used for other suitable operations, such as to treat minerals in subterranean zone 102 prior to mining operations, or to inject or introduce fluids, gasses, or other substances into subterranean zone 102.

Referring to FIG. 1, well system 100 includes an entry wellbore 105, slant wells 106, a plurality of lateral wellbores 104, and a cavity 108 associated with each slant well 106. Entry wellbore 105 extends from a surface 12 towards subterranean zones 102. Entry wellbore 105 is illustrated in FIG. 1 as being substantially vertical; however, entry wellbore 105 may be formed at any suitable angle relative to surface 12 to accommodate, for example, surface 12 geometries and/or subterranean zone 102 geometries.

Slant wells 106 extend from the terminus of entry wellbore 105 toward subterranean zones 102, although slant wells may alternatively extend from any other suitable portion of entry wellbore 105 or from surface 12. Where there are multiple subterranean zones 102 at varying depths, as illustrated in FIG. 1, slant wells 106 extend through the subterranean zones 102 closest to surface 12 into and through the deepest subterranean zones 102. There may be one or any number of slant wells 106.

As illustrated, if slant wells 106 are formed from an entry wellbore 105, then they may extend away from entry wellbore 105 at an angle designated $\alpha$, which may be any suitable angle to accommodate surface topologies and other factors similar to those affecting entry wellbore 105. If multiple slant wells 106 are formed, as illustrated, then they may be spaced in relation to each other at an angular separation of $\beta$ degrees, which may be any suitable angle, such as 60 degrees. However, slant wells 106 may be separated by other angles depending likewise on the topology and geography of the area and location of a targeted subterranean zone 102. As described in further detail below, each slant well 106 is angled toward a horizontal direction that coincides with the drilling direction for at least one lateral wellbore 104. Slant wells 106 may also include cavity 108 located at a terminus of each slant well 106 to collect fluids from subterranean zones 102.

Lateral wellbores 104 extend from each slant well 106 into an associated subterranean zone 102. Lateral wellbores 104 are shown in FIG. 1 to be substantially horizontal; however, lateral wellbores 104 may be formed in other suitable directions off of slant wells 106 and may have a curvature associated therewith. Any suitable systems and/or methods may be used to drill lateral wellbores 104; however, a particular method for drilling lateral wellbores 104 according to one embodiment of the present invention is described below in conjunction with FIGS. 2 through 3B.

Figure 2:
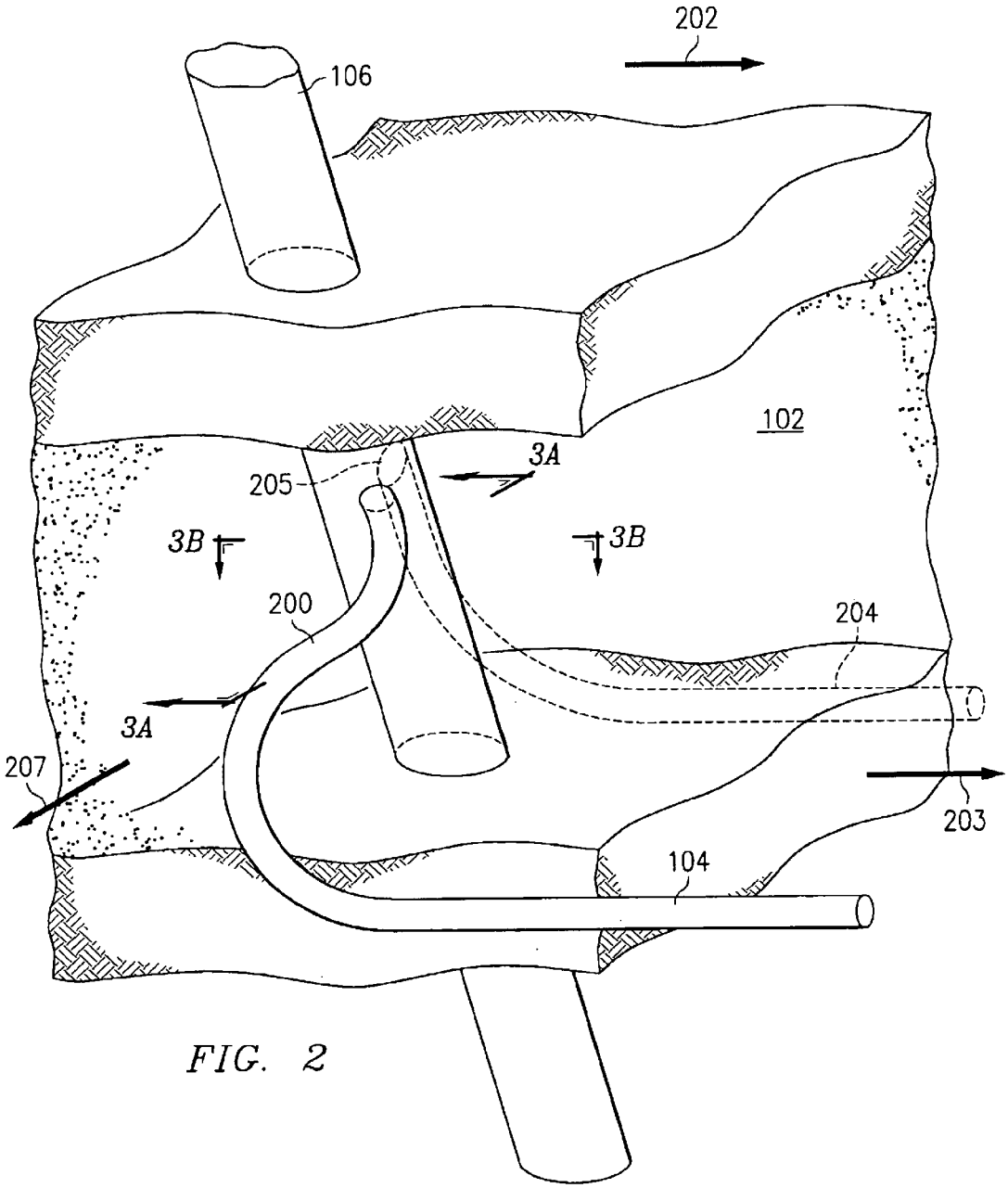
FIG. 2 is a three-dimensional perspective view illustrating how a lateral wellbore is drilled from a slant well according to one embodiment of the present invention.

FIG. 2 is a three-dimensional perspective view illustrating the drilling of lateral wellbore 104 from slant well 106 according to one embodiment of the present invention. According to the teachings of one embodiment of the present invention, lateral wellbore 104 is drilled from slant well 106 without utilizing a whipstock by first drilling an intermediate wellbore in a direction that is different from a desired drilling direction 203 of lateral wellbore 104. The drilling of intermediate wellbore 200 is described in further detail below.

Figure 3A:
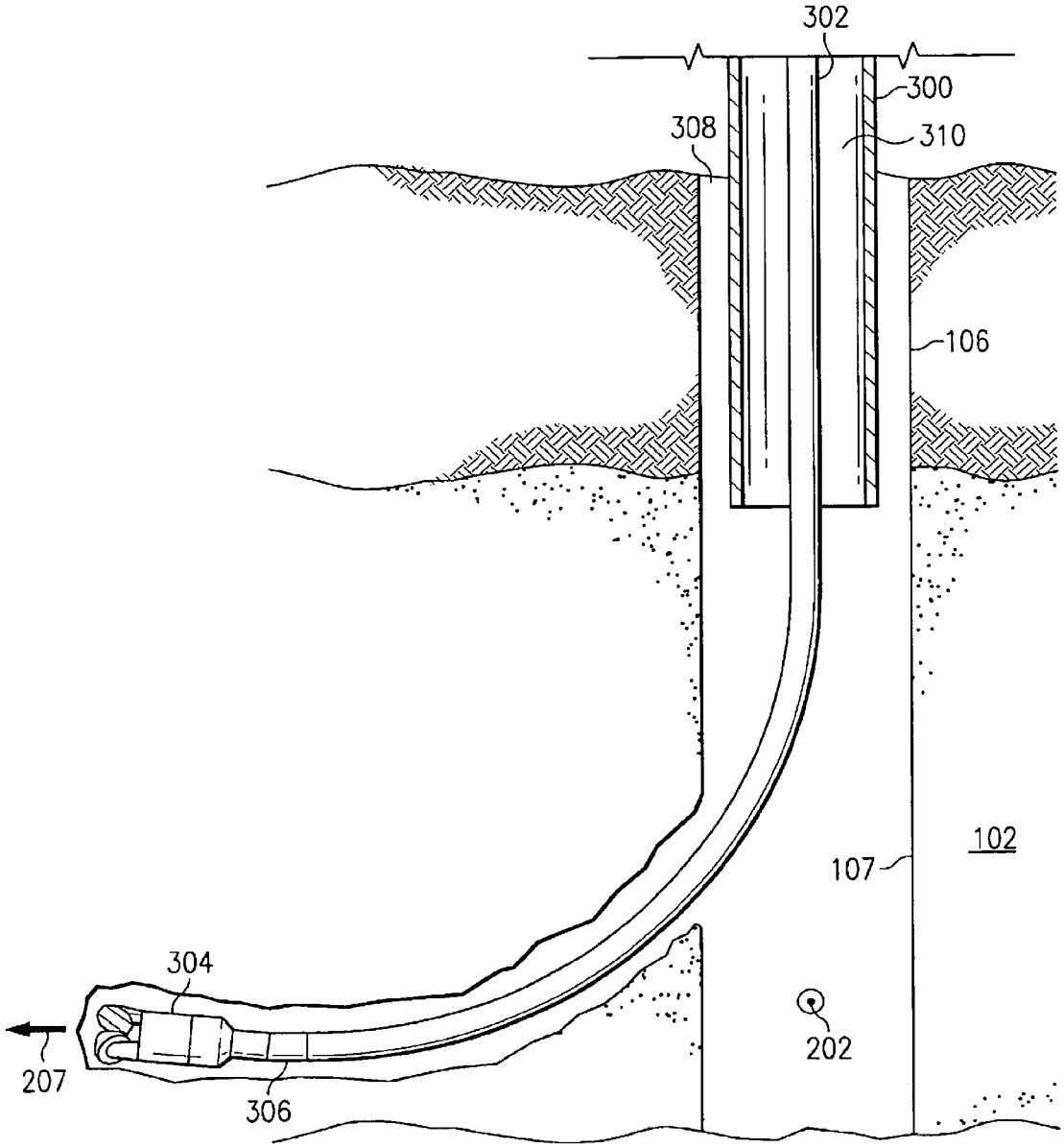

FIGS. 3A and 3B are various cross-sectional views of the perspective view of FIG. 2. Referring to FIGS. 2, 3A and 3B, slant well 106 is shown to be drilled at an angle toward a first horizontal direction 202 that coincides with desired drilling direction 203 of lateral wellbore 104. Note that the arrow representing first horizontal direction 202 in FIG. 3A is coming out of the page. Slant well 106 may be drilled using any suitable drilling methods.

To drill lateral wellbore 104, a casing string 300 may be first disposed in slant well 106, as shown best in FIG. 3A. A drill string 302 may then be disposed in casing string 300, also shown in FIG. 3A. In the illustrated embodiment, drill string 302 includes a bent sub 306 at a lower end thereof, a mud motor (not explicitly shown), and a drill bit 304. In previous methods of drilling lateral wellbores, the casing string that is disposed in a slant well has a whipstock at a lower end thereof to direct the drill bit laterally so that a lateral wellbore 204 may be drilled. This is illustrated in FIG. 2, in which lateral wellbore 204 is illustrated in hidden lines. Lateral wellbore 204 is drilled in the same direction as desired drilling direction 203 for lateral wellbore 104, except that the drilling of lateral wellbore 204 is with the use of the whipstock, whereas the drilling of wellbore 104, according to the teachings of the present invention, is utilized without a whipstock.

Lateral wellbore 204 is typically not able to be drilled without a whipstock because drill bit 304 is not able to penetrate a borehole wall 107 of slant well 106 near a point 205 on a high side portion 321 (FIG. 3B) of slant well 106, as shown in FIGS. 2 and 3B. This is because drill bit 304 is working against gravity and, when trying to penetrate borehole wall 107 of slant well 106 near point 205, drill bit 304 may deflect off borehole wall 107 because there is not enough force to penetrate or "bite into" borehole wall 107. This is one reason that intermediate wellbore 200 is drilled to create lateral wellbore 104 without the use of a whipstock, as described in further detail below. The deflecting of a drill bit off of a borehole wall is not a problem when utilizing a whipstock because a whipstock is configured in such a manner that it not only directs a drill bit toward a desired drilling direction but forces the drill bit to penetrate or "bite into" a wall of a borehole in spite of any gravity that may be encountered.

To avoid having to work against gravity and to be able to penetrate borehole wall 107 of slant well 106 without using a whipstock, drill bit 304 is initially positioned at a drill point on borehole wall 107 such that penetration of borehole wall 107 may be achieved. Intermediate wellbore 200 may then be drilled in a direction 207, as best illustrated in FIG. 3A. In the illustrated embodiment, intermediate wellbore 200 is essentially drilled from a "side portion" of slant well 106, in which direction 207 is at an angle of approximately ninety degrees offset from desired drilling direction 203 of lateral wellbore 104 in a generally horizontal plane. This is most clearly illustrated in FIG. 3B. Any suitable angle may be formed between desired drilling direction 203 and direction 207, as long as drill bit 304 is able to penetrate borehole wall 107 of slant well 106 without the use of a whipstock.

Referring to FIG. 3B, a horizontal cross-section of slant well 106 illustrates borehole wall 107 being divided into four approximately equal portions, as denoted by lines 320 in FIG. 3B. The four portions include high side portion 321 that is closest to surface 12, a low side portion 323 that is farthest from surface 12, and two side portions 322 disposed between high side portion 321 and low side portion 323. In one embodiment, drill bit 304 is positioned at a drilling point on borehole wall 107 of slant well 106 such that the drill point is within either side portions 322 or low side portion 323. Thereafter, drill bit 304 is used to drill intermediate wellbore 200 from that drill point before making a turn toward desired drilling direction 203 to drill lateral wellbore 104. Intermediate wellbore 200 includes any turns that may be formed before drilling lateral wellbore 104. As shown in FIG. 3B, the drill point is located in a side portion 322; however, other suitable drill points may be utilized. For example, the drilling point may be located at low side portion 323. If so, then intermediate wellbore 200 may first turn toward side portion 322 before turning toward desired drilling direction 203.

Under-balanced drilling may also be performed using the teachings of the present invention. As such, an inner annulus 310 is formed between the inner surface of casing string 300 and the outer surface of drill string 302, and an outer annulus 308 is formed between an outside surface of casing string 300 and the wall of slant well 106. Inner annulus 310, outer annulus 308, and drill string 302 may be used to perform under-balanced drilling. As one example, a first fluid may be circulated down drill string 201, such as drilling mud or other suitable drilling fluids, and a second fluid is circulated down inner annulus 310, such as air, nitrogen, or other relatively light fluid. Both first and second fluids then mix and flow up outer annulus 308. The purpose of the second fluid is to lighten the weight of the first fluid such that the hydrostatic head of the first fluid does not force the first fluid into the subterranean formation. As a variation, the second fluid may be circulated down outer annulus 308 and the mixture of the first and second fluids may flow up inner annulus 310.

In operation of the embodiment of the system shown in FIGS. 2 through 3B, slant well 106 is drilled using a suitable drilling method. Casing string 300 is inserted into slant well 106 and drill string 302 is then inserted within casing string 300. Once at a desired depth, drill bit 304 is then positioned at a drill point on the wall of slant well 106 so that intermediate wellbore 200 may be drilled. Since a whipstock is not included in casing string 300, there is no deflecting member to direct drill bit 304 in desired drilling direction 203. Therefore, to be able to penetrate borehole wall 107 of slant well 106, drill bit 304 is positioned at a drill point on borehole wall 107 so that penetration may be achieved. In one embodiment, the drill point is positioned against a side portion 322 of borehole wall 107. Intermediate wellbore 200 is then drilled using drill bit 304. This includes directing drill bit 304 such that drill bit 304 is oriented toward desired drilling direction 203. When drill bit 304 is oriented in desired drilling direction 203, then drill bit 304 is used to drill lateral wellbore 104, as most clearly shown in FIG. 3B.

FIG. 4 is a flow chart demonstrating an example method for drilling lateral wellbores 104 from slant well 106 according to one embodiment of the present invention.

The method begins at step 400 where slant well 106 is drilled below surface 12 of the earth. Slant well 106 is angled toward first horizontal direction 202 that coincides with desired drilling direction 203 for lateral wellbore 104. Casing string 300 is disposed in slant well 106 in step 402, and drill string 302 is disposed in casing string 300 at step 404. Drill string 302 has bent sub 306, a mud motor, and drill bit 304 coupled at a lower end thereof. Once drill bit 304 is at a desired depth, drill bit 304 is positioned adjacent to one of two side portions 322 (or low side portion 323) of borehole wall 107 at step 406. Then intermediate wellbore 200 is drilled from side portion 322 (or low side portion 323) at step 408 with drill bit 304. At step 410, lateral wellbore 104 is drilled in desired drilling direction 203 from intermediate wellbore 200. Drilling intermediate wellbore 200 before drilling lateral wellbore 104 facilitates the drilling of lateral wellbore 104 without having to utilize a whipstock at the end of casing string 300. Intermediate wellbore 200 is drilled in a direction that is different from the desired drilling direction 203 so that drill bit 304 may penetrate borehole wall 107 of slant wall 106. This is because drill bit 304 cannot penetrate borehole wall 107 when working against the force of gravity in this direction and, therefore, intermediate wellbore 200 must be drilled from either side portion 322 or low side portion 323 before drilling lateral wellbore 104 in desired drilling direction 203. This ends the method as outlined in FIG. 4.

Although the present invention is described with several embodiments, various changes and modifications may be suggested to one skilled in the art. The present invention intends to encompass such changes and modifications as they fall within the scope of the appended claims.

What is claimed is:

1. A method for drilling a lateral wellbore from a slant well, comprising:

drilling the slant well below the surface of the earth, the slant well angled toward a first horizontal direction that generally coincides with a desired drilling direction for the lateral wellbore, the slant well having a borehole wall comprising:

a high side portion closest to the surface;

a low side portion farthest from the surface; and two side portions between the high side portion and the low side portion;

disposing a drill string in the slant well, the drill string having a drill bit coupled at a lower end thereof;

positioning the drill bit in contact with one of the side portions;

drilling, from the side portion, an intermediate wellbore with the drill bit; and drilling, from the intermediate wellbore, the lateral wellbore in the desired drilling direction.

2. The method of claim 1, wherein the high side portion, the low side portion, and the two side portions each comprise approximately a quarter of the perimeter of the borehole wall.

3. The method of claim 1, wherein each of the two side portions comprise a larger portion of the perimeter of the borehole wall than each of the high side and low side portions.

4. The method of claim 1, wherein drilling the intermediate wellbore comprises drilling the intermediate wellbore at an approximately ninety degree angle from the desired drilling direction of the lateral wellbore in a generally horizontal plane.

5. The method of claim 1, further comprising:

disposing a casing string in the slant well; and disposing the drill string in the casing string.

6. The method of claim 5, further comprising disposing the casing string in the slant well such that an outer annulus is formed between the borehole wall of the slant well and an outer wall of the casing string, and disposing the drill string in the casing string such that an inner annulus is formed between an inner wall of the casing string and an outer wall of the drill string.

7. The method of claim 6, further comprising:

circulating a first fluid down an inner passage of the drill string;

circulating a second fluid down the inner annulus; and retrieving a mixture of the first and second fluids through the outer annulus.

8. The method of claim 6, further comprising:

circulating a first fluid down an inner passage of the drill string;

circulating a second fluid down the outer annulus; and retrieving a mixture of the first and second fluids through the inner annulus.

9. The method of claim 1, wherein the drill string further includes a bent sub at a lower end thereof.

10. The method of claim 1, wherein all of the drilling steps are performed without utilizing a whipstock.

11. A method for drilling a lateral wellbore from a slant well, comprising:

drilling the slant well below the surface of the earth, the slant well angled toward a first horizontal direction that generally coincides with a desired drilling direction for the lateral wellbore, the slant well having a borehole wall comprising:

a high side portion closest to the surface;

a low side portion farthest from the surface; and two side portions between the high side portion and the low side portion;

disposing a drill string in the slant well, the drill string having a drill bit coupled at a lower end thereof;

positioning the drill bit in contact with the low side portion;

drilling, from the low side portion, an intermediate wellbore with the drill bit; and drilling, from the intermediate wellbore, the lateral wellbore in the desired drilling direction.

12. The method of claim 11, wherein the high side portion, the low side portion, and the two side portions each comprise approximately a quarter of the perimeter of the borehole wall.

13. The method of claim 11, wherein each of the two side portions comprise a larger portion of the perimeter of the borehole wall than each of the high side and low side portions.

14. The method of claim 11, wherein the drill string further includes a bent sub at a lower end thereof.

15. The method of claim 11, wherein all of the drilling steps are performed without utilizing a whipstock.

16. The method of claim 11, further comprising:

disposing a casing string in the slant well; and disposing the drill string in the casing string.

17. The method of claim 16, further comprising disposing the casing string in the slant well such that an outer annulus is formed between the borehole wall of the slant well and an outer wall of the casing string, and disposing the drill string in the casing string such that an inner annulus is formed between an inner wall of the casing string and an outer wall of the drill string.

18. The method of claim 17, further comprising:

circulating a first fluid down an inner passage of the drill string;

circulating a second fluid down the inner annulus; and retrieving a mixture of the first and second fluids through the outer annulus.

19. The method of claim 17, further comprising:

circulating a first fluid down an inner passage of the drill string;

circulating a second fluid down the outer annulus; and retrieving a mixture of the first and second fluids through the inner annulus.

* * * * *